United States Patent [19]

Ralston, Jr.

[11] 4,004,989

[45] * Jan. 25, 1977

[54] METHOD FOR AUTOMATIC ADJUSTMENT OF ANODES BASED UPON CURRENT DENSITY AND CURRENT

[75] Inventor: Richard W. Ralston, Jr., Cleveland, Tenn.

[73] Assignee: Olin Corporation, New Haven, Conn.

[ * ] Notice: The portion of the term of this patent subsequent to Mar. 25, 1992, has been disclaimed.

[22] Filed: Mar. 21, 1975

[21] Appl. No.: 561,014

Related U.S. Application Data

[63] Continuation-in-part of Ser. No. 461,822, April 18, 1974, Pat. No. 3,873,430, which is a continuation-in-part of Ser. No. 272,240, July 17, 1972, abandoned.

[52] U.S. Cl. ..... 204/99; 204/128; 204/225; 204/228

[51] Int. Cl.[2] ..... C25B 1/36; C25B 15/04; C25B 15/06

[58] Field of Search ..... 204/99, 225, 228, 219, 204/220, 250, 128

[56] References Cited

UNITED STATES PATENTS

| | | | |
|---|---|---|---|
| 3,361,654 | 1/1968 | Deprez et al. | 204/99 |
| 3,464,903 | 9/1969 | Shaw | 204/99 |
| 3,476,660 | 11/1969 | Selwa | 204/128 |
| 3,531,392 | 9/1970 | Schmeiser | 204/225 |
| 3,873,430 | 3/1975 | Ralston | 204/99 |
| 3,900,373 | 8/1975 | Ralston | 204/99 |

FOREIGN PATENTS OR APPLICATIONS

| | | | |
|---|---|---|---|
| 1,212,488 | 11/1970 | United Kingdom | 204/225 |

OTHER PUBLICATIONS

G. I. Volkov et al., The Soviet Chemical Industry, No. 11, pp. 69–70, Nov., 1970.

*Primary Examiner*—G. L. Kaplan
*Attorney, Agent, or Firm*—Donald F. Clements; James B. Haglind; Thomas P. O'Day

[57] ABSTRACT

An improved method for automatic adjustment of anodes in an electrolytic cell is described which utilizes the measurement of the rate of change in current density for a given unit of distance when a minor fraction of the anodes are lowered toward the liquid cathode. When the change in rate of current density exceeds a predetermined limit, movement of the minor fraction of anodes is stopped, and another minor fraction of anodes is adjusted.

After positioning of the anodes is completed, control of the space between the anode and cathode is effected wherein current measurements and voltage measurements are obtained and compared with predetermined standards. Measurements of deviation from the predetermined standards are used to determine the direction of anode adjustment. A digital computer operably connected to motor drive means adapted to raise or lower anode sets upon appropriate electric signals from the computer is a preferred embodiment of this invention.

21 Claims, 4 Drawing Figures

METHOD FOR AUTOMATIC ADJUSTMENT OF ANODES BASED UPON CURRENT DENSITY AND CURRENT

This is a continuation-in-part, of copending application Ser. No. 461,822, filed Apr. 18, 1974, now U.S. Pat. No. 3,873,430, continuation-in-part, of application Ser. No. 272,240, filed July 17, 1972, now abandoned.

This invention relates to an improved method of determining the optimum position of a minor fraction of adjustable anodes in an electrolytic cell containing said anodes and a liquid cathode. More particularly, this invention relates to an improved method of positioning anodes in mercury cells and maintaining the optimum position.

Electrolytic mercury cells have been used commercially in the production of chlorine and caustic by the electrolysis of brine for many years. Usually these cells employ by a metal cell container which slopes slightly downward from one end to the other, and which utilizes a cathode comprised of a moving stream of mercury on the bottom of the cell. A stream of brine flows on top of the mercury cathode in the cell container. Graphite anodes and more recently, metal anodes, are adjustably secured to the top of the cell container and positioned in the brine above the mercury cathode. When a voltage is applied across the cell, current flows from the anode, through the brine electrolyte to the cathode, and causes electrolysis of the brine and the formation of gaseous chlorine, which is removed from the cell, purified and stored. Elemental sodium, another product of the electrolysis, forms an amalgam with the mercury cathode, and is removed from the cell and processed to form a caustic solution. Regenerated mercury from the amalgam is recycled for use as the cell cathode.

Because of the lack of uniformity of the surface of the cell bottom and the presence of impurities which may adhere to the cell bottom, the mercury cathode is not of uniform height throughout the length of the cell bottom. It is therefore extremely difficult to position the anodes at a distance from the cathode which provides optimum electrolysis of the brine during cell operation.

Numerous techniques have been developed to adjust the anode-cathode gap in electrolytic cells. For example, U.S. Pat. No. 3,574,073, issued Apr. 6, 1971, to Richard W. Ralston, Jr., discloses adjustment means for anode sets in electrolytic cells. In this patent, a means responsive to changes in the flux of the magnetic field generated by electrical flow in a conductor supplying the anode sets controls the opening and closing of an electrical circuit, and activates hydraulic motors which are effective to raise or lower the anode sets. In addition, a cell voltage signal and a temperature compensated amperage signal proportional to the bus bar current for the anode set are fed as input to an analog computer which produces an output reading of resistance calculated according to the formula:

$$R = \frac{E - E_r}{I}$$

where $R$ is the resistance of one anode set, $E$ is the cell voltage, $E_r$ is the reversible potential of the particular electrode-electrolyte system and $I$ is the current flowing to the anode set. Each anode set has a characteristic resistance at optimum efficiency to which that anode set is appropriately adjusted.

U.S. Pat. No. 3,558,454, which issued Jan. 26, 1971, to Rolph Schafer et al., discloses the regulation of voltage in an electrolytic cell by measuring the cell voltage and comparing it with a reference voltage. The gap between electrodes is changed in accordance with deviations between the measured voltage and the reference voltage and all electrodes in the cell are adjusted as a unit.

Similarly, U.S. Pat. No. 3,627,666, which issued Dec. 14, 1971, to Rene L. Bonfils, adjusts all electrodes in an electrolytic cell using apparatus which measures the cell voltage and current in a series of circuits which regulate the anode-cathode gap by establishing a voltage proportional to $U - RI$ where $U$ is the cell voltage, $I$ the cell current and $R$ the predetermined resistance of the cell.

A method of adjusting electrodes by measuring the currents to individual electrodes in cyclic succession and adjusting the spacing for those anodes whose measured currents differ from a selected range of current values is disclosed in U.S. Pat. No. 3,531,392, which issued Sept. 29, 1970, to Kurt Schmeiser. All electrodes are adjusted to the same range of current values and no measurement of voltage is made.

Numerous techniques have been developed in an effort to determine the optimum distance between the anode and liquid cathode in an electrolytic cell. For example, U.S. Pat. No. 3,361,654, which issued to Charles Deprez et al. on Jan. 2, 1968 describes a method for adjusting graphite anodes by comparing the change of current with time as the anode is lowered towards the cathode. When there is a sharp increase in current as the anode is lowered, a point of incipient short circuit is reached, lowering of the anode is stopped and the anode is moved in the opposite direction from the cathode for a short distance. Although this technique may be satisfactory for positioning graphite anodes, it cannot be utilized when metallic anodes are positioned in the cell because contact between the metal anodes and the mercury cathode, unlike graphite anodes, markedly changes the characteristic of the metal anodes. In addition, the incipient short circuit disturbs the mercury and the thickness on the cell bottom may be changed as a result of this technique. As a result, it is essential to avoid contact between metal anodes and the mercury cathode during cell operation.

U.S. Pat. No. 3,396,095, issued Aug. 6, 1968, to J. Van Diest et al. discloses a technique for determining optimum gap based upon current and voltage measurements.

West German Patent No. 1,804,259, published May 14, 1970, and East German Patent No. 78,557, issued Dec. 20, 1970, also describe techniques for adjusting the gap between anodes and cathodes.

While the above methods provide ways of adjusting the anode-cathode spacing in an electrolytic cell, it is well known that in a cell containing a plurality of electrodes, the optimum anode-cathode spacing for a particular electrode will depend on its location in the cell, and its age or length of service, among other factors. For example, in a horizontal mercury cell for electrolyzing alkali metal chlorides, the optimum anode-cathode spacing for an anode located near the entry of the cell is different from the spacing for one located near the cell exit. In addition, decomposition voltage varies throughout the cell as brine temperature and concentration change. Likewise a new anode can maintain a closer anode-cathode spacing than one which has been in the cell for a longer period of time or can operate more efficiently at the same spacing. In addition, after an anode has been lowered it is necessary to know whether the anode-cathode spacing is too narrow, which may cause short circuiting or loss of efficiency.

There is a need at the present time for an improved method and apparatus for positioning anodes, particularly metal anodes, and for controlling the space between an adjustable anode and a cathode which utilizes current measurements, and/or voltage measurements or a combination thereof to effect adjustment of the electrode space of individual anode sets under the varying conditions occurring in the aforesaid electrolytic cells.

It is a primary object of this invention to provide an improved method of adjusting anodes in an electrolytic cell.

Another object of this invention is to provide an improved method of automatically adjusting metal anodes to an optimum height in an electrolytic cell utilizing a liquid cathode.

These and other objects of the invention will be apparent from the following detailed description thereof.

It has now been discovered that the foregoing objects are accomplished in an electrolytic cell having adjustable anodes, an aqueous electrolyte and a liquid cathode wherein a voltage is applied across said anodes and said cathode to develop an electric current from said anodes through said aqueous electrolyte to said cathode, by utilizing the improved method for positioning an anode set or other minor fraction of said anodes at an optimum distance from said cathode which comprises:

a. positioning a minor fraction of the anodes in the cell above the cathode at a distance apart so that when this fraction of the anodes is moved slightly in either direction, there is relatively small change in the current passing through the minor fraction of anodes, b. moving the minor fraction of anodes in the direction of the cathode at a substantially constant rate, c. measuring the current passing through the minor fraction of anodes and, based upon the current measurement, calculating the change in current density per unit of distance as the minor fraction of anodes moves towards the cathode comparing the resulting calculated change with a predetermined limit, and d. when the change in current density per unit of distance reaches the desired limits, for example, in the range between about 2 and about 10 kiloamperes per square meter per millimeter, movement of the minor fraction of anodes is discontinued.

The thus adjusted minor fraction of anodes is considered to be at a known anode-cathode gap which is near or at the optimum position for the most economic operation of the cell. Another minor fraction of anodes in the same cell is then adjusted to the optimum position in the same manner, and this procedure is continued until all of the anodes within the same cell have been placed at or near the optimum position. A continuous scan of the current and voltage measurements of the anodes can then be obtained, if desired, and further movement of the anodes within the cell can then be made in order to allow for any changes in the mercury thickness or characteristics of each set of anodes in each cell as operation continues.

Further periodic control of the size of the gap between a minor fraction of the anodes, such as an anode set, and the cathode is accomplished by measuring the current to the minor fraction of anodes for a predetermined period and raising the anodes when the current exceeds a predetermined limit. In one embodiment, the anode sets are operably connected to a motor drive means adapted to raise and lower the anode sets upon receipt of electrical signals from a digital computer. The invention then further comprises the steps of:

1. obtaining N current measurements of the current to the anode set over a predetermined period, and conveying each current measurement by electric signal to the computer,
2. comparing in the computer each current measurement with a preceding current measurement and determining the difference in current, and
3. conveying an electric signal from the computer to the motor drive means to increase the space a predetermined distance when the difference in current is an increase which exceeds a predetermined limit.

In another embodiment of the invention, the improved method of this invention also comprises:

4. measuring the current to the anode set and conveying the current measurement by electric signal to the computer,
5. conveying an electric signal from the computer to the motor drive means to decrease the space between the anode set and the cathode by a predetermined distance, and after decreasing the space,
6. following steps 1–3 above.

The difference in current may be determined between any two successive current measurements or between any current measurement and a preceding current measurement during the same predetermined period or a preceding predetermined period. In addition, the difference in current may be determined between any current measurement for the anode set and an average anode set current based upon the bus current for the entire cell. Similar adjustments in the space are made when the averge difference or the square root of the average of the squares of the differences in current measurements exceed predetermined limits.

In another embodiment, a standard or set-point voltage coefficient, S, is determined for each anode set and subsequent calculations of the voltage coefficient are made and compared with the standard voltage coefficient, S. When the difference between the calculated voltage coefficient exceeds a predetermined limit above the standard voltage coefficient, S, the space is decreased a predetermined distance. When the calculated voltage coefficient exceeds a predetermined limit below the standard voltage coefficient, S, the space is increased and examination of the anode set is made to determine the cause of the problem.

In a preferred embodiment of the invention, each adjustable anode set or minor portion of the anodes is operably connected to a motor driven means adapted to raise and lower the adjustable anode sets upon receipt of electric signals from a digital computer. The rate of change in current density for the anode set or minor fraction of anodes is calculated by digital computer which in response to electric signals, senses current and distance moved by the anode set, calculates the change in current density per unit of distance and stops movement of the minor fraction of anodes when the rate of change in current density exceeds a predetermined limit. In addition, electric signals representing current and voltage are used by the digital computer to raise or lower the anode sets with the motor drive means.

The method and apparatus of the present invention provides for the adjustment of the anode-cathode spacing for individual anode sets in an electrolytic cell where the optimum anode-cathode spacing may vary for all anode sets in a cell. In addition, the selection of cells and anode sets within a cell for possible adjustment may be made randomly or in order.

The method and apparatus of this invention are particularly useful in controlling commercial electrolytic cells where large numbers of cells are connected in series and each cell contains a plurality of anode sets. FIG. 1 is a block diagram showing generally the layout of the apparatus of this invention.

Figure 1:
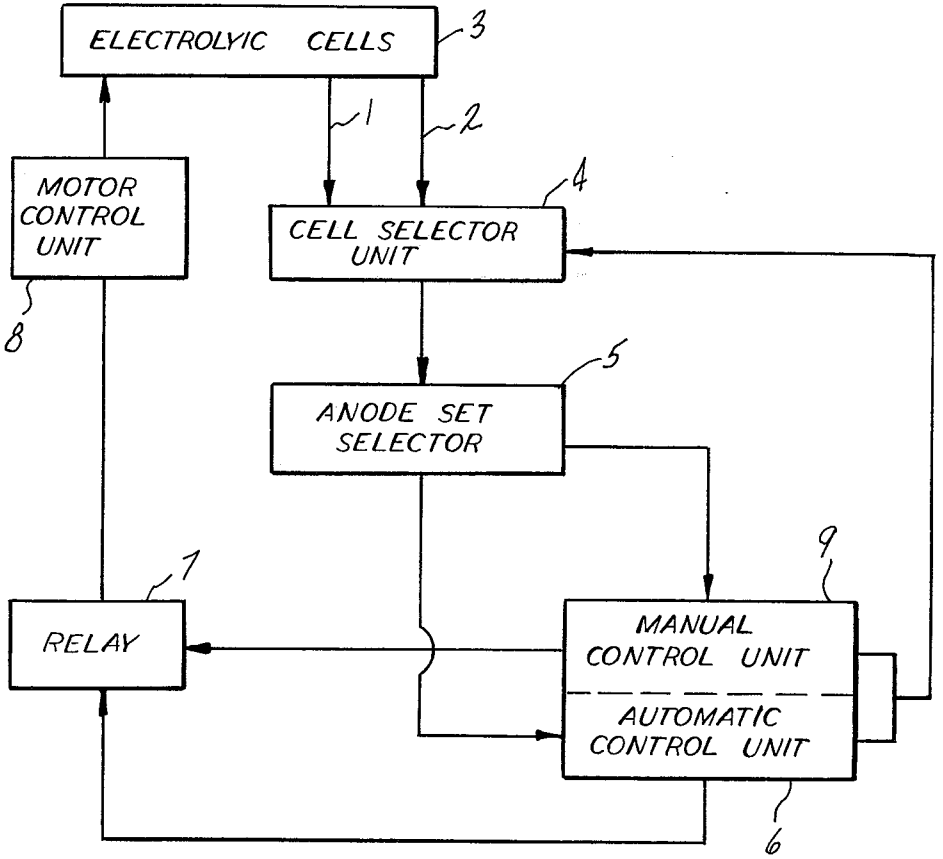

FIG. 1 illustrates the apparatus of this invention in block diagram form where electric signals representing current measurements 1 and electric signals representing voltage measurements 2 from each anode set (not shown) for each electrolytic cell 3 are selected by cell selector unit 4. Anode set selector unit 5 in response to a signal from manual control unit 9 selects electric signals for current measurements 1 and voltage measurements 2 from any desired anode set in electrolytic cell 3 through cell selector unit 4. Automatic control unit 6 transmits signals to cell selector unit 4 to select current measurements 1 and voltage measurements 2 from cell selector unit 4 for desired anode sets and performs the required calculations and comparisons with predetermined limits. When these calculations and comparisons show that raising or lowering of the anode set is necessary, appropriate electric signals are conveyed to relay 7, then to motor control unit 8 which operates upon the anode adjustment mechanism (not shown) to raise or lower the anode set. Motor control unit 8, which can be used for increasing or decreasing the anode-cathode spacing in any anode set in electrolytic cell 3, can also be controlled by manual control unit 9 through anode set selector unit 5.

Figure 2:
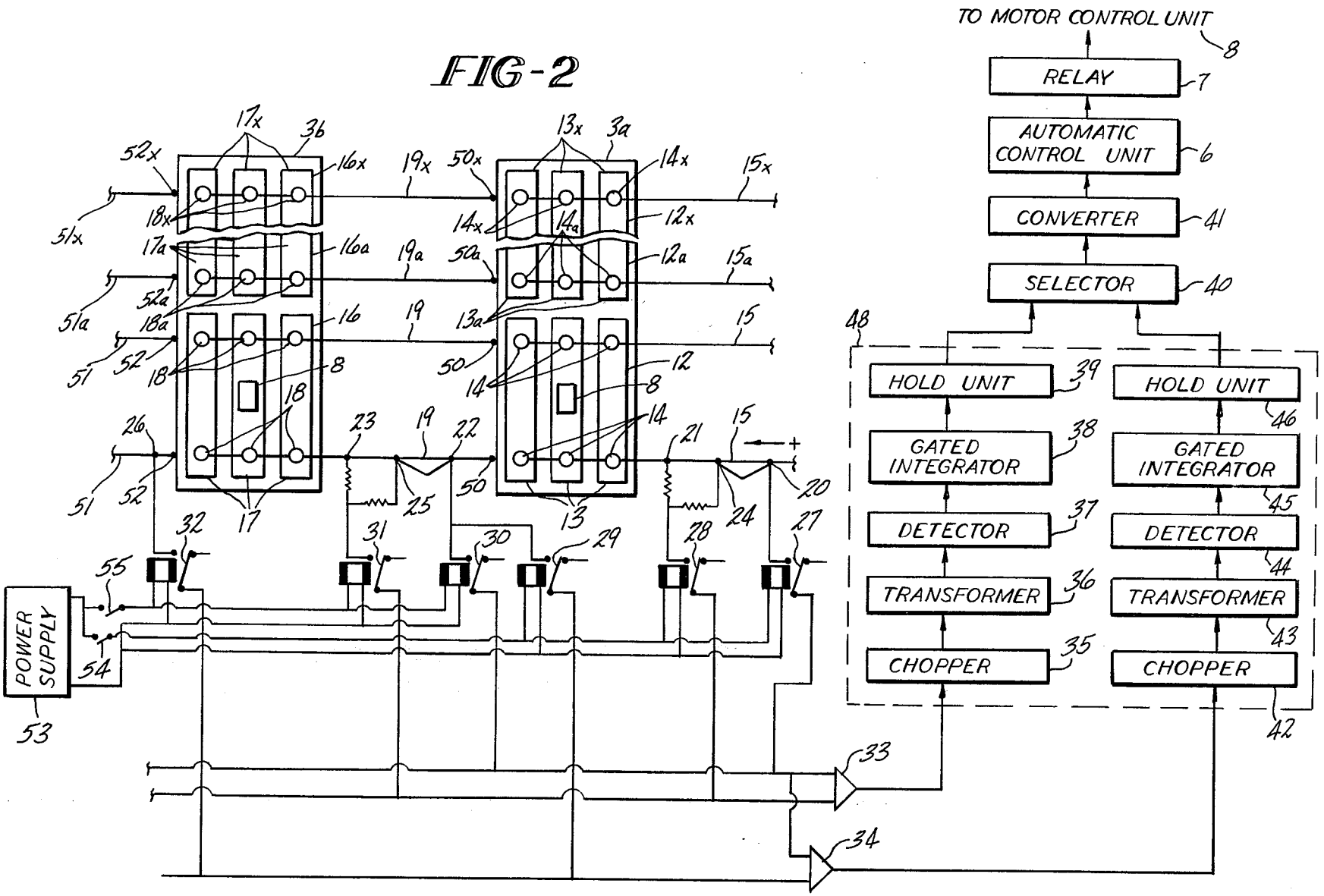
FIG. 2 is a block diagram showing one embodiment of the invention including a signal isolation and signal conditioning system utilizing a transformer.

FIG. 2 is a block diagram showing one embodiment of the signal selection and conditioning system for two adjacent electrolytic cells 3*a* and 3*b*, respectively, in series.

Electrolytic cell 3*a* has a plurality of anode sets 12, 12*a* and 12*x*. Anode set 12 is comprised of at least one anode 13, for example, three parallel anodes 13. Each anode 13 is provided with at least one anode post 14, and with two anode posts 14 preferably, as shown, with the anode posts 14 arranged in two parallel rows. A conductor 15 is connected to each row of anode posts 14 in electrolytic cell 3*a*. Current from plant supply (not shown) is conveyed through two conductors 15 to each row of anode posts 14 in anode set 12. Anode sets 12*a* and 12*x* are each comprised of three anodes, 13*a* and 13*x*, respectively, having two rows of anode posts 14*a* and 14*x*, respectively, secured to conductors 15*a* and 15*x*, respectively.

Adjacent electrolytic cell 3*b* has a corresponding number of anode sets 16, 16*a* and 16*x*. Anode set 16 is comprised of three parallel anodes 17 having two rows of anode posts 18 in each anode set 16. Anode sets 16*a* and 16*x* each have three parallel anodes 17*a* and 17*x* with two rows of anode posts 18*a* and 18*x*.

Current is conveyed from anode posts 14 to anodes 13 through the electolyte to the mercury cathode on the bottom of electrolytic cell 3*a*. A cathode terminal is positioned below each row of anode posts 14 in the bottom of electrolytic cell 3*a* and transmits current from the mercury cathode to the exterior of the bottom of electrolytic cell 3*a*, where it is connected to conductor 19. The cathode terminal is shown symbolically as cathode terminal 50 at the side of electrolytic cell 3*a*, but is actually positioned on the bottom of the electrolytic cell 3*a*, as is well known in the art, as shown in FIG. 2 of U.S. Pat. No. 3,396,095.

Each conductor 19 conveys current from cathode terminal 50 connected to the bottom of electrolytic cell 3*a* below anode posts 14 to the corresponding row of anode posts 18 in electrolytic cell 3*b*. Conductors 19*a* and 19*x* convey current from other cathode terminals 50*a* and 50*x* below rows of anode posts 14*a* and 14*x*, respectively, to anode posts 18*a* and 18*x*, respectively. The current passes in series from these anode posts to the anodes through the electrolyte, the cathode, the bottom of the cell to cathode terminals 52, 52, 52*a* and 52*x*, respectively, and continues through conductors 51, 51*a* and 51*x*, respectively, through the remainder of the cells to the plant supply.

The resistance between terminals 20 and 21 on conductor 15 is measured to determine the voltage drop between these points and to obtain an electric signal which is proportional to the current flow to anode set 12. Similarly, the resistance between terminals 22 and 23 on conductor 19 is measured to obtain an electric signal which is proportional to the current flow to anode set 16.

The distance between terminals 20 and 21 is the same as the distance between terminals 22 and 23. The current signals from these terminals are transmitted to thermistor circuits 24 and 25, respectively, where the current signals are temperature compensated. Current signals from thermistor 24 are transmitted across relay circuits 27 and 28 to amplifier 33. Current signals from thermistor 25 are transmitted across relay circuits 30 and 31 to amplifier 33.

Relay circuits 27 and 28 are activated through power supply 53 when switch 54 is moved to a closed position. Relay circuits 30 and 31 are also activated through power supply 53 when switch 55 is moved to a closed position.

The voltage drop across anode set 12 in electrolytic cell 3*a* is measured between terminal 20 on conductor 15 and terminal 22 on conductor 19, which is the corresponding terminal for the corresponding anode set of the adjacent electrolytic cell 3*b*. Similarly, the voltage drop across anode set 16 in electrolytic cell 3*b* is measured between terminal 22 on conductor 19 and terminal 26 on conductor 51, which is the corresponding terminal for the corresponding anode set of the next adjacent electrolytic cell. Thus, the "voltage drop across an anode set", such as anode set 12, is based upon the flow of current from a given point 20 on conductor 15 through anode posts 14 to anodes 13, through the electrolyte, mercury cathode and cathode terminal 50 to terminal 22 on conductor 19.

A similar voltage drop for anode set 16 in cell 3*b* is measured between terminals 22 and 26 on conductors 19 and 51, respectively. Electric signals representing the voltage drop across anode set 12 are conveyed across relay circuits 27 and 29 to amplifier 34. Similarly, electrical signals representing the voltage drop across anode set 16 are conveyed across relay circuits 30 and 32 to amplifier 34. Relay circuits 27 and 29 are activated through power supply 53 when switch 54 is moved to a closed position. Relay circuits 30 and 32 are also activated through power supply 53 when switch 55 is moved to a closed position.

Current signals are obtained for the other conductor 15 to anode set 12, as well as all of the other conductors 15*a*, 15*x*, 19, 19*a*, and 19*x* in the same manner as described above and as shown in FIG. 2 for conductor 15.

Voltage signals based upon voltage drop across terminals 20 and 22 are obtained for the other row of anode posts 14 of anode set 12 as well as for each of the other rows of anode posts for anode sets 12*a*, 12*x*, 16, 16*a*, and 16*x* in the same manner as described above and as shown in FIG. 2.

Thus for an electrolytic cell containing ten anode sets, each anode set having two rows of anode posts connected to the anodes in the set, there are 20 conductors, each providing a current signal to a separate amplifier 33 and a voltage signal to a separate amplifier 34.

Temperature compensated current signals are amplified in amplifier 33 and conveyed to chopper 35 in signal isolation and conditioning system 48 where they are converted from direct current signals to alternating current signals. These signals are then transmitted at cell potential to transformer 36 having one terminal of the primary winding connected to cell potential and one terminal of the secondary winding connected to earth potential. The current signals are isolated in transformer 36 and leave at earth potential in order to be compatible with automatic control unit 6. The current signals are transmitted from transformer 36 to detector 37 where the isolated current signals are converted from alternating current signals to direct current signals, and the resulting direct current signals are transmitted to a gated integrator 38 for rejection of electrical noise, particularly that generated by the rectifier which supplies current to electrolytic cells 3*a* and 3*b*. Noise conditioned current signals are transmitted to hold unit 39 (capacitor) and stored until selected by selector 40.

In a similar manner, the voltage signals are amplified in amplifier 34 and conveyed to a chopper 42, then at cell potential are conveyed to a transformer 43, where the voltage signals are isolated and leave at earth potential. These signals are converted from alternating to direct current in detector 44 and then to gated integrator 45 where rejection of electrical noise is also effected. The resulting voltage signals are transmitted to hold unit 46, (capacitor) where they are stored until selected by selector 40 in the same manner as current signals stored in hold unit 39. In response to a programmed electric signal from automatic control unit 6, (or if desired, an electric signal initiated manually from manual control unit 9 of FIG. 1), current signals and voltage signals from selector 40 for any desired anode set such as anode set 12 or 16 are selected and transmitted to convertor 41 where they are converted from analog form to binary form and then transmitted to automatic control unit 6 for processing. In automatic control unit 6, the selected signals are compared with predetermined values and when necessary, the selected anode set is raised or lowered by an appropriate electric signal from automatic control unit 6 through relay 7 to motor drive 8, which operates to raise or lower the selected anode set.

Figure 3:
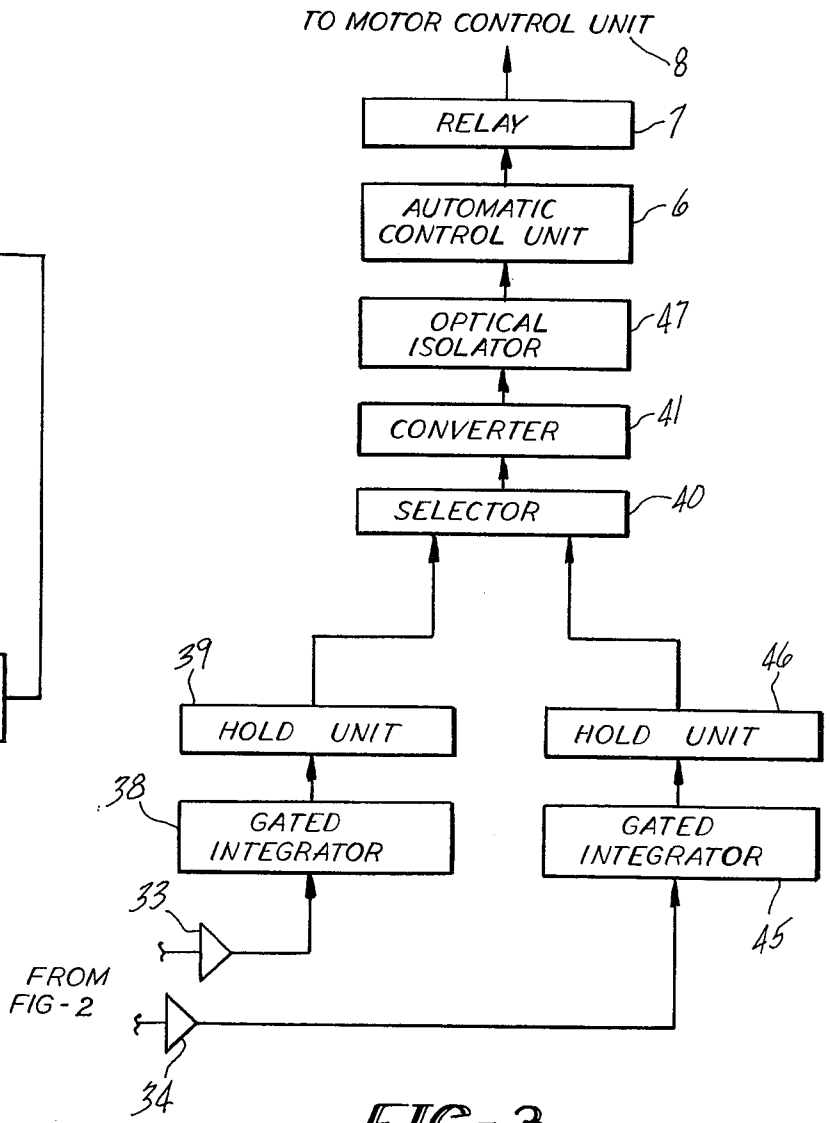
FIG. 3 is a block diagram showing another embodiment of the invention including a signal isolation and signal conditioning system utilizing an optical isolator.

FIG. 3 shows another embodiment of the invention utilizing an optical isolator. In FIG. 3, temperature compensated current signals from amplifier 33 in FIG. 2 are conveyed to gated integrator 38 where rejection of electrical noise, particularly that generated by the rectifier which supplies current to electrolytic cells 3*a* and 3*b*, is effected. Noise conditioned current signals are transmitted to hold unit 39 and stored until selected by selector 40.

In a similar manner, voltage signals from amplifier 34 of FIG. 2 are conveyed in FIG. 3 to a gated integrator 45 where rejection of electrical noise is also effected. The resulting voltage signals are transmitted to hold unit 46, where they are stored until selected by selector 40 in the same manner as current signals stored in hold unit 39. In response to a programmed electric signal from automatic control unit 6, or, if desired, a manually initiated electrical signal, current signals and voltage signals from selector 40 for any desired anode set are selected, the signals are transmitted to convertor 41 where they are converted from analog form to binary form and then transmitted to optical isolator 47.

Signals enter optical isolator 47 at cell potential, are isolated and transmitted at earth potential to automatic control unit 6, where the selected signals are compared with predetermined values, and when necessary the selected anode set is raised or lowered in the same manner as described for FIG. 2.

Figure 4:
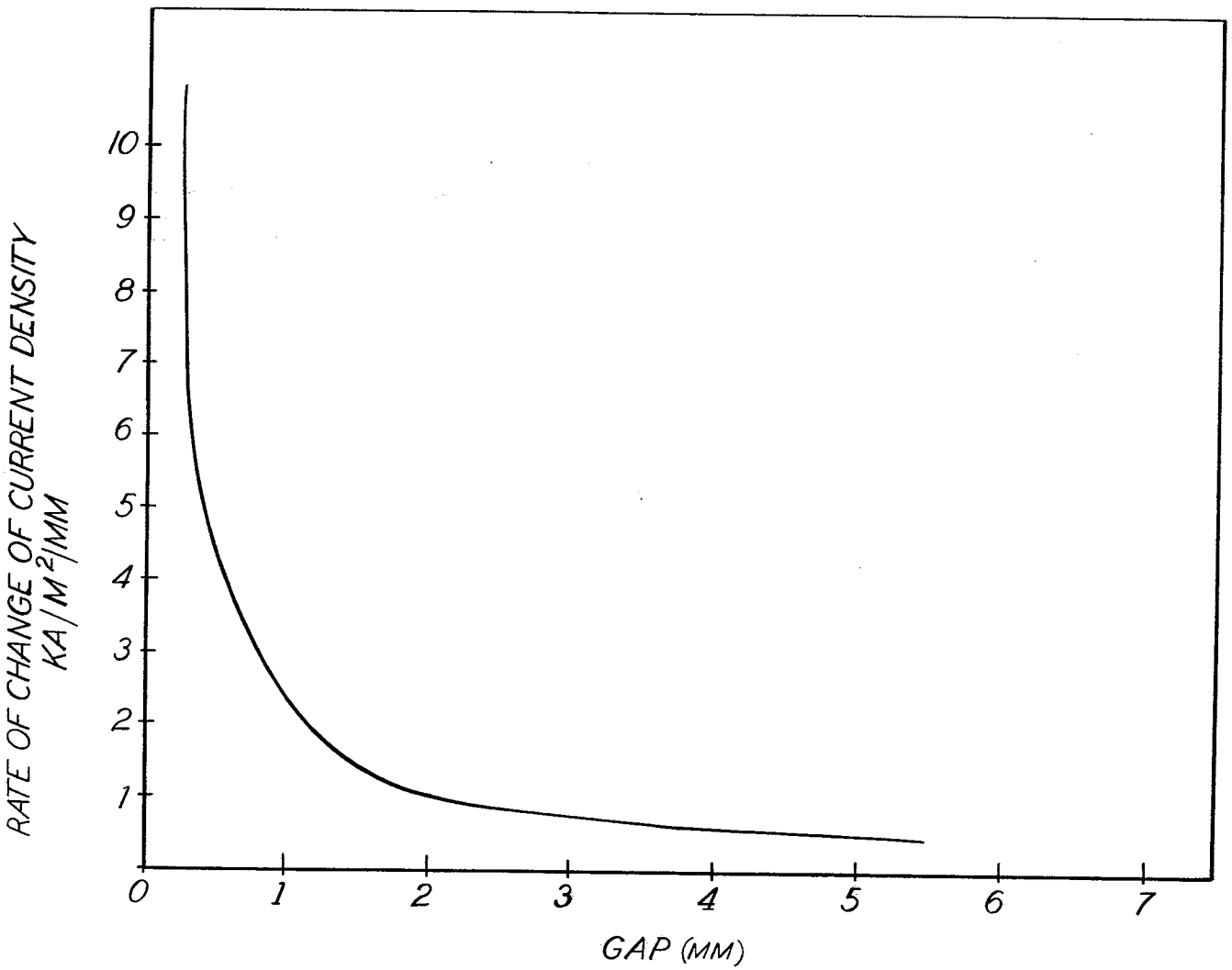
FIG. 4 is a curve showing a typical relationship between the rate of change of current density per square meter per millimeter with change in gap distance in millimeters for an electrolytic mercury cell.

FIG. 4 shows the relationship of the rate of change in current density in terms of kiloamperes per square meter per millimeter of gap with the change in gap or distance between the anode and cathode in millimeters for a typical anode set. A sharp increase in the current density at about 1.0 millimeter gap shows that the optimum position is being approached for this anode set without obtaining an undesirable incipient short circuit.

More in detail, the method of the present invention may be used on a variety of electrolytic cell types used for different electrolysis systems. It is particularly useful in the electrolysis of alkali metal chlorides to produce chlorine and alkali metal hydroxides. More particularly, it is highly suitable for horizontal electrolytic cells having a liquid metal cathode such as mercury, as disclosed, for example in U.S. Pat. Nos. 3,390,070 and 3,574,073, which are hereby incorporated by reference in their entirety.

As indicated in U.S. Pat. No. 3,574,073, issued Apr. 6, 1971, to Richard W. Ralston, Jr., horizontal mercury cells usually consist of a covered elongated trough sloping slightly towards one end. The cathode is a flowing layer of mercury which is introduced at the higher end of the cell and flows along the bottom of the cell toward the lower end. The anodes are generally composed of slotted rectangular blocks of graphite or metal distributors having an anodic surface comprised of titanium rods or mesh coated with a metal oxide secured to the bottom of the distributor. Anode sets of different materials of construction may be employed in the same cell, if desired. The anodes are suspended from at least one anode post such as a graphite rod or a protected copper tube or rod. Generally, each rectangular anode has two anode posts, but only one, or more than two, may be used, if desired. The anodes in each anode set are placed parallel to each other, the anode posts forming parallel rows across the cell. The bottoms of the anodes are spaced a short distance above the flowing mercury cathode. The electrolyte, which is usually salt brine, flows above the mercury cathode and also contacts the anode. Each anode post in one row of an anode set is secured to a first conductor, and the other row of anode posts is secured to a second conductor. Each conductor is adjustably secured at each end to a supporting post secured to the top of the cell. Each supporting post is provided with a drive means such as a sprocket which is driven through a belt or chain or directly by a motor such as an electric motor, hydraulic motor or other motor capable of responding to electric signals from automatic signal device 6.

Although the invention is particularly useful in the operation of horizontal mercury cells used in the electrolysis of brine, it is generally useful for any liquid cathode type electrolytic cell where adjustment of the anode-cathode space is necessary for efficient operation.

The number of electrolytic cells controlled by the method and apparatus of this invention is not critical. Although a single electrolytic cell can be controlled, commercial operations containing more than 100 cells can be successfully controlled.

Each electrolytic cell may contain a single anode, but it is preferred to apply the method and apparatus of this invention to electrolytic cells containing a multiplicity of anodes. Thus the number of anodes per cell may range from 1 to about 200 anodes, preferably from about two to about 100 anodes.

It is preferred, particularly on a commercial scale to adjust anode sets when adjusting the space between the anodes and cathode of electrolytic cells. An anode set may contain a single anode, but it is preferred to include from two to about 20 anodes, and preferably from about three to about 12 anodes per anode set. Voltage and current measurements are obtained for each conductor for each row of anode posts of each anode set in each cell.

Current to any part of the cell is calculated by the formula $$I = E/(K_1 \times G + K_2)$$

where $I$ = current in kiloamperes $E$ = voltage difference between the measured voltage and the decomposition voltage which is 3.1 volts for salt brine in a mercury cell $G$ = gap in millimeters between the top of the mercury cathode and the bottom of the anode $K_1$ = Resistivity of the brine $K_2$ = All other resistances including conductors, polarization, and the like.

In a mercury cell used for salt brine electrolysis, $K_1$ is about 0.000019 $\Omega/M^2/MM$, and $K_2$ generally ranges from about 0.00004 to about 0.00006 $\Omega/M^2$.

When a minor fraction of the anode is moved toward the cathode the voltage (E) stays relatively constant because, although the current can increase greatly in the minor fraction of anodes, the total current in the rest of the cell is much greater than in the minor fraction of anodes and the relative decrease is small.

The rate at which the current to a minor fraction of anodes changes as the anode is moved toward the cathode is shown in FIG. 4. Using the above equation, the rate of change can be calculated to be:

$$\frac{dI}{dG} = -\frac{EK_1}{(G^*K_1 + K_2)^2}$$

The curve in FIG. 4 shows the rate of change of current with varying gap based on experimental data for metal anodes in a mercury cell. As the gap is decreased to less than about 1 mm the rate of change increases sharply.

It can be seen that the method is very sensitive in determining when this gap is reached. With this method it is possible to determine when the anode is close to the mercury without lowering the anode until incipient short circuiting occurs.

The minor fraction of anodes which are lowered in accordance with the process of this invention may range from about 2.5 to about 25 percent of the total anodes in the cell, and preferably from about 5 to about 15 percent of the total anodes in the cell. When a minor fraction of the anodes is lowered in this manner, there is initially very little change in the current density through the anode set as the anode set is moved progressively towards the cathode. A computer, such as a digital computer, is utilized on signals received from the minor fraction of anodes being lowered to measure voltage, current and calculate current density per square meter of anode surface per millimeter as the distance between the cathode and the anode is decreased. The initial current density increases relatively slowly until the anode approaches the mercury cathode. When this occurs, there is a marked increase in the current density. For example, in a commercial electrolytic mercury cell containing 10 sets of five anodes, each anode having a surface area of about 4 feet by 9 inches, when one anode set is lowered from about 3 millimeters gap position for a distance of about 0.1 millimeter, the current density may increase about 3.5 percent. This relatively small increase continues until the anode set is only about 1 millimeter from the cathode. At this point a movement of an additional 0.1 millimeter will cause the current density to increase by about 10 percent, or more. For example, when the anode is about 3 millimeters from the cathode the rate of increase of current density is about 1 kiloampere per square meter per millimeter. When the anode is further moved towards the cathode to a gap of about 1 millimeter, the rate of current density change rapidly increases to about 3.5 kiloamperes per square meter per millimeter. Additional movement of the anode set towards the anode to a gap of about 0.5 millimeters causes the rate of current density change to increase to about 5 kiloamperes per square meter per millimeter. Thus it can be seen that adjustment of the anode set to a point where the rate of current density increase ranges from about 2 to 10 and preferably from about 3 to about 5 kiloamperes per square meter per millimeter will position the anode at about 0.5 to about 1.0 mm from the cathode. Further adjustment from this position can be made if desired. When the rate of current density change is less than about 0.5 kiloamperes per square meter per millimeter, operation of the cell under those conditions is less economical and when the rate of current density change exceeds about 10 kiloamperes per square meter per millimeter the gap is so small that there is a risk of contacting the cathode and causing an incipient short circuit, which will adversely effect cell operation and severely damage metal anodes, when metal anodes are employed.

The rate of lowering of the anode set during this adjustment period is generally at the rate of from about 0.1 to about 1.0 and preferably in the range from about 0.3 to about 0.5 millimeters per second.

Appropriate limits are programmed into the computer so that any signal sent to the motor drive of the anode adjustment system of the electrolytic cell will not lower the anode set at a rate exceeding the above-mentioned rates of descent. Furthermore, appropriate signals are programmed into the computer to limit the total distance that the anode set is lowered to a point where the current density will not exceed previously determined limits, for example, not in excess of about 10 kiloamperes per millimeter per second for a cell of the type described above.

After the initial minor fraction of anodes in the cell has been adjusted in this manner, a second anode set is then subjected to the same procedure to determine the optimum gap. This procedure is then repeated until all the anode sets in the cell have been adjusted to the optimum position.

Although FIG. 4 presents a typical curve for a commercial type cell and anodes of this type cell will follow the general shape of the curve, it will be recognized by those skilled in the art that the variations in size and shape of the cell and electrodes may change the position of the curve, but the same method of this invention can be used to determine the optimum position for a given anode set.

The novel process of this invention permits adjustment of each anode set to the optimum position in order to obtain maximum efficiency in operation of the cell. In addition, individually adjusting each anode set in this manner takes into account differences and characteristics of the cell bottoms, thickness of mercury and foreign objects on the cell bottom that may adversely affect the efficiency of the cell.

In accomplishing further control of the anode-cathode spacing by the method of the present invention, two electrical signals are periodically generated and measured for each anode set. One corresponds to the current flow in the conductor for the anode set and may be obtained by measuring the voltage drop between a plurality of terminals, (20 and 21 of FIG. 2) spaced apart a suitable distance along the conductor. The spacing suitably varies between 3 and 100 inches, for example about 30 inches, but should be the same distance for all conductors. It is desirable, but not essential, that the terminals be located laterally in the middle of the conductor, in a straight segment of conductor of uniform dimensions. Current measurements may also be obtained using other well known methods such as by the Hall effect or other magnetic detection devices.

The current signal may be compensated for temperature changes in the conductor by a thermal resistor 24 being embedded or otherwise attached to the section of conductor being used as the source of the current signal.

The voltage signal is generated and measured between corresponding terminals on the conductors for corresponding anode sets on two adjacent cells when a multiplicity of cells are controlled.

The novel process of this invention can be used in combination with other techniques for adjusting the anode-cathode spacing in an electrolytic cell having at least one anode set. For example, in response to an electric signal from the manual or automatic control unit, the voltage drop is measured between a plurality of terminals along a section of each conductor supplying current to the anode set. This electrical signal represents the current flow in the conductor for the anode set. A voltage signal is measured across the anode set. A voltage signal is measured across the anode set, generally between corresponding terminals (20 and 22) on the conductors for two adjacent anode sets in cells having a plurality of anode sets. These electrical signals are processed and used to calculate the voltage coefficient Vc according to the formula:

$$Vc = \frac{E}{KA/M^2} = \frac{V - D}{KA/M^2}$$

where $E$ is the voltage defined above, $V$ is the measured voltage drop across an electrolytic unit such as an anode set 3, (one row of anode posts 14 for anode set 12, between corresponding points of adjacent conductors 15 and 19); $D$ is the decomposition voltage for the electrolysis being conducted, and $KA/M^2$ is the current density in kiloamperes per square meter of cathode surface below the anode set. In the electrolysis of sodium chloride in a mercury cell for producing chlorine, the value for D is about 3.1.

The calculated voltage coefficient Vc during operation is compared with an original standard voltage coefficient S which was calculated at start-up in accordance with the above formula for voltage coefficient, Vc. Standard voltage efficient S may vary with a number of factors such as the material of construction of the anode (graphite or metal), the form and condition of the anodes (blocks of graphite which are slotted or drilled, metal mesh or rods coated with a noble metal or oxide) and the location of the anode set in the cell, among other factors. As indicated in "Intensification of Electrolysis in Chlorine Baths with a Mercury Cathode", *The Soviet Chemical Industry*, No. 11, November, 1970 pp. 69–70, the standard voltage coefficient (K or S) was found to vary as follows:

| K, standard voltage coefficient, V/kA | Condition |
|---|---|
| 0.55 | no device for regulating anode position |
| 0.3 | use of device for lowering anode |
| 0.2 | intensive perforation of the anodes |
| 0.14 | increased perforation of the anodes |
| 0.09 | use of titanium anodes with ruthenium dioxide coating |
| 0.022 | anodes specially placed in the amalgam |

When the anode set is comprised of metal anodes having a titanium distributor with an anodic surface formed of small parallel spaced-apart titanium rods coated with an oxide of a platinum metal secured to the bottom of the distributor, a standard voltage coefficient ranging from about 0.09 to about 0.13 is entered as the set-point into the program of automatic control unit 6. A deviation, $k$, which is the permissable range of deviation from S, is also entered into the program. Generally, $k$ varies from about 0.1 to about 10, and preferably from about 2 to about 8 percent of S.

After positioning anode set 12 as described above and entering the values for S and $k$ into the program, anode set 12 is lowered a small predetermined distance, from about 0.05 to about 0.5, and preferably from about 0.15 to about 0.35 mm. Then two electrical signals are generated and measured for each conductor 15 of anode set 12. One electric signal corresponds to the current flow in conductor 15 for anode set 12, and may be obtained by measuring the voltage drop between a plurality of terminals, preferably two (20 and 21) spaced a suitable distance apart along the conductor as described above.

The other electric signal is the voltage drop which is measured between terminals (20 and 22) on the corresponding conductors 15 and 19 across anode set 12. When a multiplicity of cells are controlled by the method and apparatus of this invention, the terminals are on the conductors for the corresponding anode sets of two adjacent cells.

The current signals and the voltage signals for each conductor 15 to anode set 12 are transmitted to automatic control unit 6 as described above in the discussion of FIG. 2. It is preferred to obtain the average of a series of N current measurements and the average of a series of N voltage measurements for each conductor 15 for a predetermined period. For example, automatic control unit 6 is programmed to obtain current measurements and voltage measurements at the rate of from about 10 to about 120, and preferably from about 20 to 60 measurements per second. These measurements are obtained for a period of time ranging from about 1 to about 10, and preferably from about 2 to about 5 seconds. The maximum difference in the current measurements in the series at this position i.e., a gap of at least about 3 mm between the anode and cathode, is determined and utilized as described below in the second current analysis. After the average current measurement and average voltage measurement is obtained for each series of measurements for each conductor 15, the average current measurement and average voltage measurement is obtained for each anode set 12. These average values are then used by automatic control unit 6 to calculate the voltage coefficient for anode set 12 in accordance with the above formula for Vc.

After anode set 12 is in a position where the voltage coefficient falls within the deviation $k$ of value S, the current measurements of conductor 15 for anode set 12 are also analyzed to determine whether the anode is too close to the cathode. If desired, the current analyses is made before adjustment of the anode set based upon voltage coefficient. In performing the current analyses, each current measurement is compared with the preceding current measurement to determine the amount of current increase, and where the current increase exceeds one of several predetermined limits the anode-cathode spacing is immediately increased a predetermined distance. In the first analysis, if the increase in current between the current measurements made immediately before and immediately after the decrease in anode-cathode spacing is greater than a predetermined limit, the anode-cathode spacing is immediately increased. For example, if the anode set is lowered a distance within the above-defined ranges, for example about 0.3 mm, and an increase in current in excess of a predetermined limit occurs, for example, an increase of more than about 5 percent above the previous current measurement, automatic control unit 6 is programmed to transmit an electric signal to motor drive means 8 to cause the anode-cathode spacing to be immediately increased a distance within the above-defined ranges. If the decrease in anode-cathode spacing is smaller than 0.3 mm, a proportionately smaller increase in current differences is used as a limit to effect raising of the anodes.

In a second current analysis, if anode set 12 has not been raised in the first current analysis, a series of N current measurements are taken for conductors 15 for a predetermined period in the ranges described above to determine the magnitude of current fluctuations. The second current analysis is made based upon the average magnitude of the current fluctuations or differences as determined by any convenient method prior to comparing with a predetermined average difference limit. This average difference limit is determined, for example, by doubling the average difference in the current measurements made in the series N when the anode set was initially installed at a large gap between the anode and cathode of at least about 3 mm. The average difference in current in the series of measurements obtained at the initial position generally ranges from about 0.2 to about 0.4 percent of the current to the anode set in that series and thus the predetermined limit for average current difference in a series N ranges from about 0.4 to about 1.6 percent. The term "average difference" when used in the description and claims to define the magnitude of the current fluctuations is intended to include any known method of averaging differences. For example, in a preferred embodiment a calculation is made for $\Sigma\Delta^2/N$, where $\Delta$ is the difference in current between each successive reading in the series and $N$ is the total number of current measurements taken. If this average difference is greater than the predetermined average difference limit, the anode-cathode spacing is immediately increased a predetermined distance. As an alternate, the average difference may be obtained by the calculation $$\frac{\sqrt{\Sigma\Delta^2}}{N}$$

or any other similar statistical technique.

A third current analysis determined from the series N of current measurements is whether the current continues to increase for each measurement during series N during a predetermined time period described above. If the current continues to increase for each measurement, the anode-cathode spacing is immediately increased, for example, to the previous position. The number of measurements and the predetermined time period used in this analysis are within the ranges described above, but are more preferably about 180 measurements in four seconds.

The fourth analysis of the current measurements determines whether an increase in current for any two measurements during series N, is greater than a predetermined limit, for example, an increase of about 6–8 percent. If so, the anode-cathode spacing is immediately increased by an appropriate electric signal from automatic control unit 6 to motor drive unit 8.

A fifth current analysis compares each current measurement in the series with the previous current measurement, and if the difference between two successive current measurements exceeds a predetermined limit, the distance between the anode and cathode is increased by transmitting an appropriate electrical signal from automatic control unit 6 to motor drive unit 8. When one current measurement is exceeded by the next successive current measurement in an amount from about 0.5 to about 3 percent, and preferably from about 1 to about 1.5 percent of the prior current measurement, the distance between the anode and cathode is increased as described above.

In a sixth current analysis, if any current measurement exceeds the average bus current for the entire electrolytic cell by a difference ranging from 10 to 50 percent and preferably from about 20 to about 40 percent of the average cell current for the entire electrolytic cell, then the anode set is raised a predetermined distance.

If any of the current analyses require raising of the anode set a predetermined distance, a new series of current and voltage measurements are obtained and a new voltage coefficient, Vc, is calculated. If the calculated voltage coefficient is below S by more than deviation *k*, an electrical signal is transmitted from automatic control unit 6 to motor drive unit 8 to raise anode set 12 a small distance within the ranges described above. If the calculated voltage coefficient is above S by more than deviation *k*, the anode set is lowered a predetermined distance. If the new voltage coefficient is within the limits *k*, then the current analyses are repeated.

After a position is found for anode set 12 where the voltage coefficient is within the above defined predetermined range and none of the above defined current analysis requires raising anode set 12, it may be retained in this position until subsequent automatic scanning, which is defined more fully below, shows the need for further movement of the anode.

Upon comparing calculated coefficient Vc with predetermined standard coefficient S for a selected anode set, if the value falls outside of *k*, where *k* is the permissible range of deviation from S, an adjustment of the anode-cathode spacing is made. If the second adjustment results in a Vc exceeding S by deviation *k*, the minor fraction of anodes, or anode sets, is readjusted to determined a new standard voltage coefficient S for the anode set. In this procedure, the spacing of the anode set is first increased a predetermined amount to insure that the spacing is above about 3 mm. The minor fraction of anodes is then lowered as described above at a substantially constant rate within the above defined range for rate of lowering and the rate at which the current density increases is determined as the anode set is being lowered. When the rate reaches a value indicating a gap of about 0.5 to about 1 mm, for example, (about 3 $KA/M^2/MM$) movement of the anode set is stopped.

The current readings are then analyzed for conditions indicating that the anode set is too close to the cathode.

One analysis determines whether the current continues to increase for greater than a predetermined time period, for example, about 4 seconds, and if so the anode-cathode spacing is immediately increased.

Another analysis determines whether the total increase in current after the anode set has stopped moving, exceeds a predetermined limit, for example, an increase of 6–8 percent, and if so the anode-cathode spacing is immediately increased.

If the first two current analyses do not indicate close approach of the anode to the cathode, a series of N current measurements are taken. An analysis is made to determine the magnitude of current fluctuations over a predetermined time period. The average magnitude of the current fluctuations is determined by any convenient method prior to comparing with a predetermined average difference limit as described above.

If these analyses do not show extremely close approach or incipient short circuit, the indicated gap is generally in the range of about ½ to 1 mm. This is considered to be near the optimum gap for operation of the cell. However, if this position is too close for stable long term operation, the anode may be raised, for example, about 1 mm for a resulting gap in the range of about 1–1½ to 2 mm.

More readings of current and voltage are then taken and the value for Vc at this position is calculated. The standard voltage coefficient, S is then reset to the later Vc value for this resulting gap, providing the new S is not outside the range of B which is equal to from about 30 percent less up to about 200, and preferably from about 20 percent less up to 100 percent more than original S. For example, if the old S is 0.125, the new S is set in the range from about 0.100 to about 0.250. If the new S exceeds this range the computer is programmed to provide a signal that consideration should be given for replacement of the anode set. If the new S is below this range, the computer is programmed to raise the anode set until the new S is within the above mentioned described range B for S.

Current and voltage signals used in the anode adjustment method by comparing the calculated and standard voltage coefficient may be the average from readings taken for a chosen period of time at a selected rate per time unit. If desired, individual readings may be used by comparing with a non-adjacent prior reading such as the tenth prior reading, in order to minimize signal noise.

Cells and anode sets within a cell can be selected for adjustment randomly or serially and the selection can be made manually or by automatic control. Upon selection of a given cell for adjustment all current and voltage signals for the anode sets in the cell are taken and processed simultaneously to give readings which are truly comparable. Likewise, cells and anode sets may be omitted from the adjustment method.

In another embodiment of the method of the present invention, the anode-cathode spacing for an anode set is controlled by periodically measuring the current to an anode set, comparing the current reading with a predetermined standard and increasing the anode-cathode spacing when the standard is exceeded by a predefined limit.

All anode sets in a selected cell may be simultaneously adjusted using the above methods. The method of the second current analysis can also be employed to locate in a series of adjacent cells, the cell having the highest amount of current fluctuation.

Automatic control unit 6, when scanning shows voltage coefficient and current measurements to be within predetermined limits, may also provide appropriate electric signals to motor drive unit 8 to lower anode set 12 a predetermined distance, $r$, obtain another set of measurements of current and voltage coefficient and continue lowering anode set incrementally a predetermined distance until the voltage coefficient or current analyses indicates that the anode set should be raised a predetermined distance, $r$. Automatic control unit 6 then provides signals to lower anode set 12 a fraction of $r$, for example ½ $r$, and a new set of measurements are obtained. If measurements do not require moving anode set 12 from this position, it is retained here until subsequent scanning shows the need for further adjustment.

In a further embodiment used with the method of the present invention, all anode sets for all cells in operation are serially scanned periodically and the current and voltage readings for each anode set compared with its predetermined limits. Where the current reading exceeds predetermined limits, the anode-cathode spacing is increased. This periodic scan detects current overloads to any anode set on a continuing basis. It requires about three seconds for a group of 58 cells containing about 580 anode sets, and any suitable interval between scans may be selected, for example, 1 minute. If during a scan, the anode-cathode spacing for an anode set is increased, the scan may be repeated for all anode sets for all operative cells.

A further embodiment used with the method of the present invention comprises counting the frequency of change in the anode-cathode spacing for a particular anode set during a predetermined time period and where this frequency exceeds a predetermined number, to remove this anode set from automatic control. For example, when the frequency of changing the position of the anode is in the range of from about 5 to about 100 and preferably from about 10 to about 40 times per day, an appropriate alarm should be indicated to require inspection of the anode. This alarm may be indicated for example, by the sounding of a noise alarm, activating a light on a control panel or causing a message to be printed out on a reader-printer unit associated with a computer.

The following Example is presented to define the invention more fully. All parts and percentages are by weight unless otherwise specified.

EXAMPLE I

A horizontal mercury cathode cell for electrolyzing aqueous sodium chloride to produce chlorine containing 10 anode sets of 5 metal anodes per set was selected by the cell scanner unit. Current and voltage signals for all 10 anode sets were received simulataneously for about 5 seconds until about 180 readings of current and of voltage were received for each anode set. The average voltage, current, and the difference between each current reading and the previous current reading was determined by a digital computer for the series of readings. The voltage coefficient was calculated for each anode set according to the formula:

$$Vc = \frac{V - 3.1}{KA/M^2}$$

Anode set 2, with a cathode surface area of 2.4 square meters, was found to have a Vc of 0.140 based on an average voltage of 4.3 and an average current of 18.86 kiloamperes. When Vc was compared with the standard coefficient S of 0.115 for anode set 2, it was found to have a value above the deviation range $k$, where $k$ was ± 5 percent. Original S was 0.110.

When the coefficient comparison determined the value of Vc was above S by a value greater than k, a signal from the computer activated a relay which energized a motor to increase the anode-cathode spacing by 3 mm.

The computer then activiated a relay which energized the motor to decrease the anode-cathode gap at a rate of about 0.3 mm per second. It then took readings at a rate of 50 per second and determined the rate of increase in current density by comparing the most recent reading with the tenth prior reading to reduce the effect of signal noise. When the rate of increase reached 3 KA per $M^2$ per mm (an estimated 1 mm anode-cathode gap) the anode set was stopped at this position. A number of measurements were made and analyzed as follows:

1. Analyzed current measurements to determine whether current continued to increase over a period of about 4 seconds. The increase in current stopped before the expiration of the 4 second period. No change in the anode set position was made because of this analysis.
2. The total increase in current during that period was less than about 5 percent. No change in the anode position was made because of this analysis.
3. More than 100 current measurements were analyzed for current fluctuation determined by the formula: $\Sigma\Delta^2/N$. The fluctuation was found to fall within the predetermined limit of 0.5 percent, which indicated that the anode-cathode gap was stable and that the anode could remain at this position.
4. Voltage coefficient, Vc, was calculated to be 0.110 which was within the allowable range B for S of from 0.080 to 0.200. The standard voltage coefficient "S" for this anode set was then reset to the new value of 0.110.
5. Readings were then taken for all anode sets on the cell and the Vc calculated for each was found to have a value within 5 percent of the stored values of S. No further adjustments were made and the next cell to be adjusted was selected.

What is claimed is:

1. In an electrolytic cell containing adjustable anodes operably connected to motor drive means adapted to raise and lower said anodes upon receipt of electric signals from a digital computer, a liquid cathode and an aqueous electrolyte wherein a voltage is applied across said anodes and said cathode to develop an electric current from said anodes through said aqueous electrolyte to said cathode, the improved method for positioning a minor fraction of said anodes at an optimum distance from said cathode which comprises a. positioning a minor fraction of said anodes above said cathode at a distance apart so that when said minor fraction of anodes is moved in either direction an incremental distance, there is a relatively small change in current passing through said minor fraction of anodes, b. moving said minor fraction of anodes in the direction of said cathode at a substantially constant rate, and conveying electric signals to said computer to indicate the distance travelled by said minor fraction, c. measuring said current through said minor fraction of anodes, conveying electric signals to said computer to indicate said current and calculating in said computer the change in the current density per unit of distance as said minor fraction of anodes moves toward said cathode, comparing the resulting calculated change in current density with distance with a predetermined limit, d. conveying signals to said motor drive means to discontinue movement of said minor fraction of anodes towards said cathode when the change in said current density per unit of distance reaches a predetermined limit, and e. after said discontinued movement, measuring the current to said minor fraction of anodes for a predetermined period, conveying electric signals to said computer to indicate said current for said predetermined period, comparing said signals with a predetermined limit, and sending signals to said motor drive means to raise said minor fraction of anodes when the current during the predetermined period increases beyond a predetermined limit.

2. The method of claim 1 after measuring current for said predetermined period, wherein said improvement also comprises comparing the maximum current measurement during said predetermined period with the current initially attained when said minor fraction of anodes was stopped, and raising said minor fraction of anodes when the difference between the initial current and the maximum current attained during said predetermined period exceeds a predetermined limit.

3. The method of claim 1 after measuring current for said predetermined period, wherein said improvement also comprises calculating the average difference of said current measurements obtained during said predetermined period and raising said minor fraction of anodes when said average difference exceeds a predetermined limit.

4. The method of claim 1 wherein an alarm is activated when the frequency of change in the position of said minor fraction of anodes exceeds the rate of from about five to about 100 changes per day.

5. The method of claim 4 wherein said adjustable anodes are graphite anodes.

6. The process of claim 4 wherein said anodes are metal anodes.

7. The process of claim 6 wherein said frequency in change in position exceeds the rate of from about 10 to about 40 changes per day.

8. The method of claim 7 wherein said predetermined limit for change in current density per unit of distance is within the range from about 2 and about 10 kiloamperes per square meter per millimeter.

9. The method of claim 8 wherein said predetermined limit is in the range from about 3 to about 5 kiloamperes per square meter per millimeter.

10. The method of claim 8 wherein said minor fraction of anodes is in the range from about 2.5 to about 25 percent of the total anodes in the cell.

11. The method of claim 10 wherein said minor fraction of anodes is the range between about 5 and about 15 percent of the total anodes in the cell.

12. The method of claim 11 wherein all of the anodes in the cell are positioned above the optimum distance before adjusting said minor fraction.

13. The method of claim 11 wherein said minor fraction of anodes is moved in the direction of said cathode at the rate of between about 0.1 and about 1.0 millimeter per second.

14. The method of claim 7 wherein said minor fractions of anodes is raised a predetermined height to improve long term operations of the cell.

15. The method of claim 14 wherein said predetermined height is in the range from about 0.5 to about 1.5 mm.

16. The method of claim 7 wherein said minor fraction of anodes, after said discontinuing movement is a. lowered a predetermined distance towards said cathode, b. a series of N current measurements are obtained for current to said minor fraction of anodes, and c. raising said minor fraction of anodes when any current measurement in said series exceeds any other current measurement in said series by a predetermined amount.

17. The method of claim 16 wherein said minor fraction of anodes is raised when any two successive current measurements in said series was an increase beyond a predetermined limit.

18. The method of claim 16 wherein said minor fraction of anodes is raised a predetermined distance when the current continues to increase for each measurement of said series N for a predetermined period.

19. The method of claim 7 wherein said improved method further comprises:

a. calculating at start-up an original standard voltage coefficient S, for a minor fraction of said anodes in accordance with the formula:

$$S = Vc = \frac{V - D}{KA/M^2}$$

where:

1. $V$ is the voltage across said minor fraction of anodes,
2. $D$ is the decomposition voltage of said electrolyte,
3. $KA$ is the current to said minor fraction of anodes, and
4. $M^2$ is the area in square meters of the cathode surface below said minor fraction of anodes, b. continuing operation of the cell for a predetermined period, c. measuring the voltage across said minor fraction of anodes, conveying electric signals representing said voltage to said digital computer, d. measuring the current to said minor fraction of anodes, e. calculating the voltage coefficient Vc according to said formula, f. comparing said Vc with said standard voltage coefficient S for said minor fraction of anodes, g. adjusting the space between said minor fraction of anodes and said cathode where the difference between Vc and S falls outside of $k$, where 1. $k$ is the permissible range difference between Vc and S for said minor fraction of anodes, h. calculating a second voltage coefficient Vc and comparing said Vc with said standard voltage coefficient S, i. where said second voltage coefficient falls outside of $k$, reprogramming said standard voltage coefficient S, within the range B, wherein B is in the range of from about 30 percent below to about 200 percent above said original standard voltage coefficient, S, and repeating the procedure of claim 1.

20. The procedure of claim 19 wherein said B is in the range from about 20 percent below to about 100 percent above said original voltage coefficient, S.

21. The process of claim 1 wherein the procedure of claim 1 is applied to a plurality of said minor fractions of anodes until all of the anodes in said cell have been positioned at optimum distance above said cathode.

* * * * *